US005143823A

United States Patent [19]

Kunitz

[11] Patent Number: 5,143,823

[45] Date of Patent: Sep. 1, 1992

[54] COLOR PHOTOGRAPHIC RECORDING MATERIAL CONTAINING COLOR COUPLERS

[75] Inventor: Friedrich-Wilhelm Kunitz, Wermelskirchen, Fed. Rep. of Germany

[73] Assignee: Agfa Gevaert Aktiengesellschaft, Leverkusen, Fed. Rep. of Germany

[21] Appl. No.: 762,426

[22] Filed: Sep. 19, 1991

[30] Foreign Application Priority Data

Oct. 3, 1990 [DE] Fed. Rep. of Germany ..... 4031159

[51] Int. Cl.[5] ..... G03C 7/36

[52] U.S. Cl. ..... 430/556; 430/557

[58] Field of Search ..... 430/556, 557

[56] References Cited

U.S. PATENT DOCUMENTS 4,356,258 10/1982 Usui et al. ..... 430/557
4,525,450 6/1985 Itoh et al. ..... 430/552
4,617,256 10/1986 Kunitz et al. ..... 430/557

*Primary Examiner*—Lee C. Wright
*Attorney, Agent, or Firm*—Connolly & Hutz

[57] ABSTRACT

A color photographic recording material containing yellow couplers corresponding to the following formula is distinguished during chromogenic development by high sensitivity, steep gradation and high color density (even where development is carried out in the absence of benzyl alcohol). The yellow image dyes are highly resistant to moist or dry heat.

in which

X is a group releasable during the color coupling reaction;

$R_1$ is a $C_{1-18}$ alkyl radical;

$R_2$ is a $C_{1-18}$ alkyl radical or aralkyl.

4 Claims, No Drawings

COLOR PHOTOGRAPHIC RECORDING MATERIAL CONTAINING COLOR COUPLERS

This invention relates to a color photographic recording material comprising at least one silver halide emulsion layer and containing a non-diffusing α-acylacetanilide yellow coupler, of which the anilide group is substituted by a urea group, incorporated by emulsification.

It is known that colored photographic images can be produced by chromogenic development, i.e. by development of silver halide emulsion layers which have been exposed to form an image with suitable dye-producing developer substances (so-called color developers) in the presence of suitable color couplers, the developer oxidation product formed in accordance with the silver image reacting with the color coupler to form a dye image. The color developers used are normally aromatic compounds containing primary amino groups, more especially of the p-phenylenediamine type.

In practice, color couplers and the dyes produced therefrom by chromogenic development have to satisfy a number of requirements. Thus, the rate at which the color couplers couple with the oxidation product of the color developer should be as high as possible and a high maximum color density should be obtainable. The color couplers and the dyes obtained therefrom should show adequate stability to light, elevated temperature and moisture. This applies both to fresh material and also to processed material. For example, the residual coupler still present in the white parts of the processed material should not turn yellow. In addition, the dyes should show adequate stability to gaseous reducing or oxidizing agents. In addition, they should be anchored in non-diffusing form in the image layer and should be deposited in fine-grained form during the chromogenic development process. Finally, the dyes formed from the color couplers during the chromogenic development process should show a favorable absorption curve with a maximum which corresponds to the color of the particular component image required, and minimal secondary absorptions.

The requirements stated above apply particularly to yellow couplers because yellow couplers are often arranged in the uppermost dye-producing layer of color photographic recording materials and, hence, not only are particularly exposed to environmental effects, they also influence the underlying layers, particularly in regard to sharpness. Accordingly, any measures by which the layer loading of, in particular, the layer containing yellow couplers can be reduced are of advantage. For this reason, it is particularly advantageous to use 2-equivalent yellow couplers.

α-Acylacetanilide yellow couplers containing an N-acylsulfamoylphenyl group are known, for example from GB-A 909,318. However, the known yellow couplers are not satisfactory in every respect. At the present time, a particular problem is that, in some processing cycles, the presence of benzyl alcohol is essential for obtaining uniformly high color densities, particularly of the yellow dyes. However, the presence of benzyl alcohol in the developer readily gives rise to the deposition of tar-like masses in the developer tank. Another disadvantage is that benzyl alcohol is readily oxidized so that the developer bath has to be carefully monitored and kept constant to ensure uniform development results.

Accordingly, it is desirable to develop such recording materials in the absence of benzyl alcohol.

The problem addressed by the present invention was to provide yellow couplers for a color photographic recording material which dissolve readily in various oil formers and which can be developed to yellow image dyes with a high color yield, even in the absence of benzyl alcohol in the developer.

The present invention relates to a color photographic recording material containing at least one photosensitive silver halide emulsion layer and, associated therewith, a non-diffusing o-acylacetanilide yellow coupler of which the anilide group is substituted by a substituent containing an N-acylsulfamoyl group, characterized in that the yellow coupler corresponds to the following formula

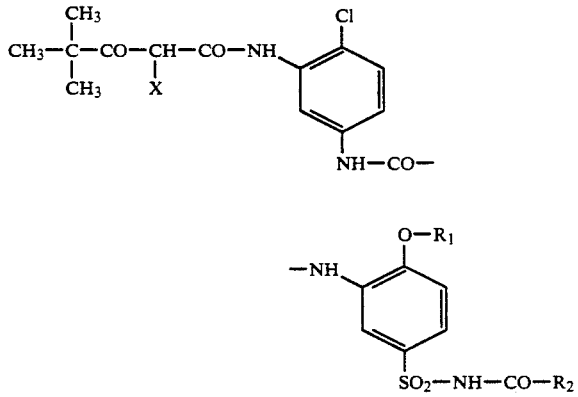

which

X is a group releasable during the color coupling reaction;

alkyl;

$R_1$ is alkyl;

$R_2$ is alkyl or aralkyl.

An alkyl radical represented by $R_1$ or $R_2$ is linear or branched, unsubstituted or substituted and contains 1 to 18 C atoms. $R_1$ is preferably an alkyl radical containing at least 8 C atoms while $R_2$ is an alkyl radical containing 1 to 4 C atoms or aralkyl. An aralkyl radical represented by $R_2$ is, for example, benzyl.

The group X releasable during the color coupling reaction is, for example, an organic group which is generally attached to the coupling position of the coupler molecule by an oxygen or nitrogen atom. If the releasable group is a cyclic group, it may be attached to the coupling position of the coupler molecule either directly through an atom which is part of a ring, for example a nitrogen atom, or indirectly through an intermediate binding link.

Releasable groups such as these are known in large numbers as leaving groups of 2-equivalent yellow couplers.

Examples of releasable groups attached by oxygen correspond to the formula $$-O-R_3,$$

in which $R_3$ is an acyclic or cyclic organic radical, for example alkyl, aryl, a heterocyclic group or acyl which is is derived, for example, from an organic carboxylic or sulfonic acid. In particularly preferred releasable groups of this kind, $R^4$ is an optionally substituted phenyl group. Groups such as these are described, for example, in US-A-3,408,194 and in DE-A-24 56 076.

Examples of releasable groups attached by nitrogen can be found in the following German Offenlegungsschrifts (DE-A-):

20 57 941, 21 63 812, 22 13 461, 22 19 917, 22 61 361, 22 63 875, 23 18 807, 23 29 587, 23 44 155, 23 63 675, 24 33 812, 24 41 779, 24 42 703, 25 28 638, 25 28 860, 26 37 817, 28 18 373, 28 42 063, 30 20 416, 36 26 219, 36 30 564, 36 36 824, 36 44 416.

They are all 5- or 6-membered heterocyclic rings which are attached to the coupling position of the coupler by a ring nitrogen atom. The heterocyclic rings often contain activating groups, for example carbonyl or sulfonyl groups or double bonds, adjacent the nitrogen atom by which they are attached to the coupler molecule.

The following are examples of groups X (leaving groups) releasable during the color coupling reaction:

Leaving groups

1)

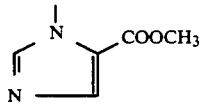

2)

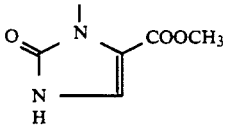

3)

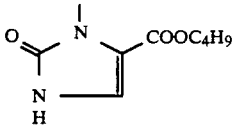

4)

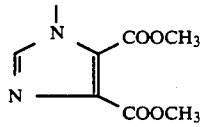

5)

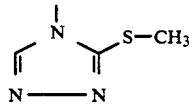

6)

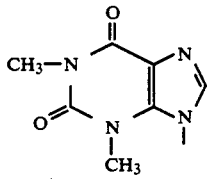

7)

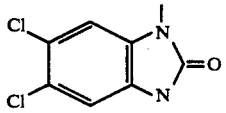

8)

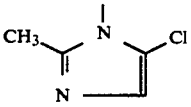

-continued

Leaving groups

9)

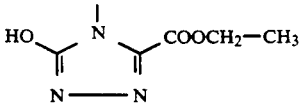

10)

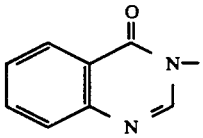

11)

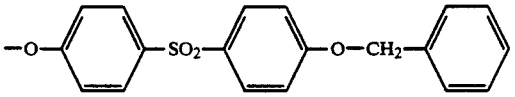

12)

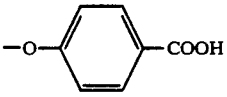

13)

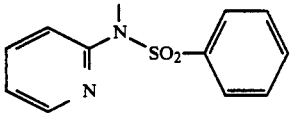

14)

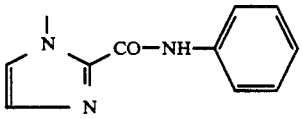

15)

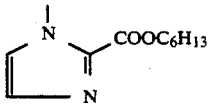

16)

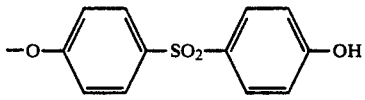

17)

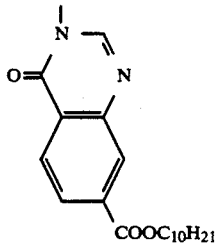

18)

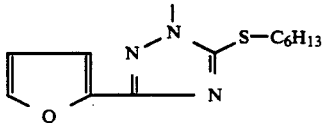

the following are examples of yellow couplers according to the invention:

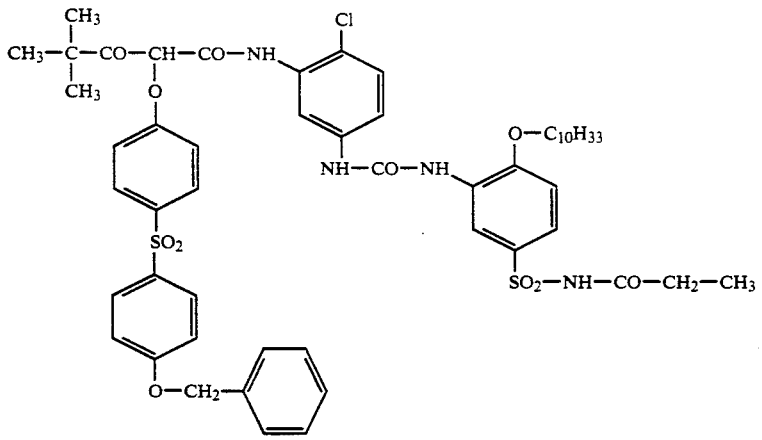

Y-1

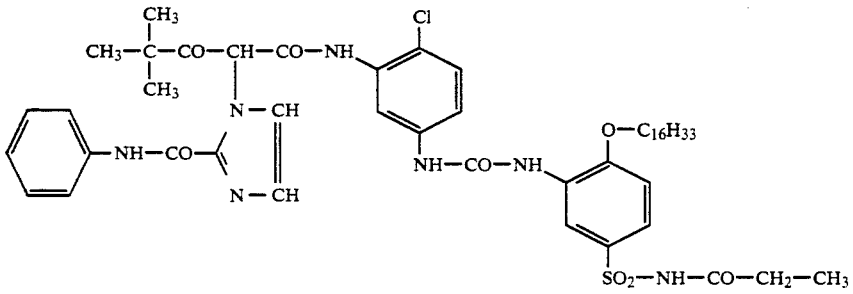

Y-2

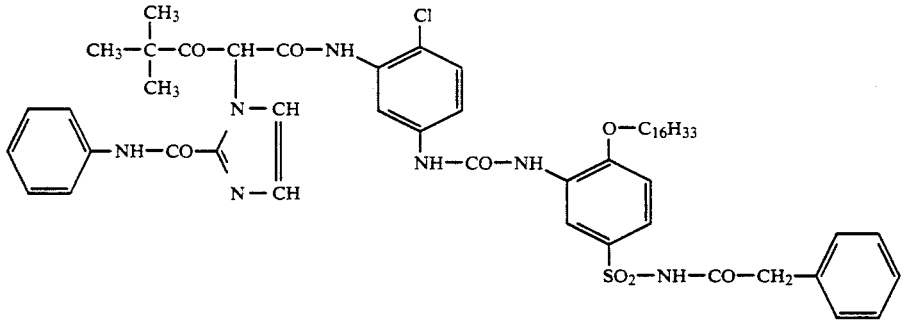

Y-3

The preparation of the yellow couplers according to the invention is described in the following with reference by way of example to yellow coupler Y-2.

PREPARATION OF YELLOW COUPLER Y-2

Step 1

2-Cetyloxy-5-sulfamoyl-(phenoxycarbanilide)

412 g (1 mol) 2-cetyloxy-5-sulfamoyl aniline are suspended in 1,000 ml dry acetonitrile. 90 g (0.57 mol) chloroformic acid phenyl ester are added dropwise over a period of 30 minutes at room temperature. The temperature is then increased to the boiling point of the acetonitrile.

Another 90 g (0.57 mol) chloroformic acid phenyl ester are added dropwise from a dropping funnel over a period of about 30 minutes. The solid product passes into solution. HCl gas is given off. After refluxing for 2 hours, the hot solution is filtered and then cooled to room temperature. The colorless crystallizate is filtered under suction and washed three times with acetonitrile. After drying in air, 2-cetyloxy-5-sulfamoyl-(phenoxy carbanilide) melting at 110° C is obtained in a yield of 446 g (84% of the theoretical).

Step 2

2-Cetyloxy-5-(N-propionylsulfamoyl)-phenoxycarbanilide 261.5 g (0.5 mol) of a solution of 2-cetyloxy-5-sulfamoyl phenoxy carbanilide (step in 500 ml acetonitrile (anhydrous) is heated to the boiling temperature. 54.3 ml (0.625 mol) propionic acid chloride are added dropwise from a dropping funnel over a period of 30 minutes. The reaction solution is refluxed for 10 h. HCl gas escapes. On completion of the reaction, the reaction mixture is cooled to room temperature, filtered under suction and washed with cold acetonitrile. The air-dry crude product is recrystallised from alcohol. Colorless crystals melting at 126.C are obtained in a yield of 270 g (92% of the theoretical).

Step 3

Parent coupler for Y-2

268.5 g (1 mol) pivaloylacet-(2-chloro-5-aminoanilide), 569.1 g (1.02 mol) 2-cetyloxy-5-(N-propionylsulfamoyl)phenoxycarbanilide and 34.5 ml (0.25 mol) triethylamine are dissolved in 2,000 ml dimethyl acetamide and the resulting solution is heated with stirring for 1 h to 100° C. The solution is then cooled to room temperature, stirred into 5 1 water and adjusted to pH 3 with 5 N HCl. The viscous oil is taken up in ethyl acetate. The ethyl acetate phase is washed twice with water and then dried over sodium sulfate. After the ethyl acetate has been distilled off, the residue is recrystallized from ethanol. Pure white crystals melting at 154.C are obtained in a yield of 410 g (54% of the theoretical).

Step 4

190.6 g (0.25 mol) of the parent coupler (step 3) are suspended in 400 ml dichloromethane. 20.5 ml (0.25 mol) sulfuryl chloride are added dropwise at room temperature, followed by stirring for 1 h at room temperature. The dichloromethane is then distilled off completely in vacuo. The residue is recrystallized from alcohol with addition of active carbon. Colorless crystals melting at 132.C are obtained in a yield of 139 g (70% of the theoretical).

Step 5

Yellow coupler Y-2

(a) 21.5 g imidazole-2-carboxylic acid anilide are suspended in 65 ml ethanol. 29.4 ml tetramethyl guanidine are added to the resulting solution.
(b) 79.7 g of the chlorinated parent coupler (step 4) are dissolved hot in ethanol.

The hot solution b) is added dropwise to the suspension (a). Occasional cooling ensures that the temperature of the reaction mixture does not exceed +40° C. The reaction mixture is stirred for 1 h at temperatures of +30° C. to 40° C. The reaction solution is filtered and then stirred onto a mixture of 200 ml water, 100 g ice and 20 ml concentrated HCl. The oily product is taken up in ethyl acetate. The organic phase is extracted by shaking twice with water and then dried with sodium sulfate.

The ethyl acetate is completely evaporated off in a water jet vacuum. The residue is recrystallized from 3 times the quantity of ethanol. The yield of colorless coupler comprises 18.3 g (20% of the theoretical). The crystals have a melting point of 119°-120° C.

The yellow couplers according to the invention are distinguished above all by excellent solubility and by little tendency to crystallize in organic solvents, particularly water-immiscible solvents of high boiling point, such as for example tricresyl phosphate isomer mixture or dibutyl phthalate. This has a favorable effect by reducing the loading of the layer.

In addition, they show excellent resistance to diffusion in photographic layers both during casting and during photographic processing. Another advantage of the yellow couplers according to the invention is that they may readily be precipitated onto latices and introduced in this form into the photographic layers.

Another advantage of the yellow couplers according to the invention is their high stability to moisture and heat and also the stability of the yellow dyes produced from them to heat, moisture and light.

Finally, another advantage is that, even where processing is carried out in the absence of benzyl alcohol, the yellow couplers according to the invention give satisfactory sensitometric results with no reduction in color density.

In addition, the yellow couplers according to the invention are distinguished by favorable sensitometric properties, more particularly high sensitivity, and also steep gradation and high color density of the yellow image dyes.

The yellow couplers according to the invention are suitable for any type of color photographic recording materials. Examples of color photographic materials are color negative films, color reversal films, color positive films, color photographic paper.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive silver halide emulsion layer, at least one green-sensitive silver halide emulsion layer and at least one blue-sensitive silver halide emulsion layer and, optionally, intermediate layers and protective layers.

Binders, silver halide grains and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A.G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic emulsion may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal films while silver chloride bromide emulsions of high chloride content up to pure silver chloride emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example from 12:1 to 30:1.

The silver halide grains may also have a multiplelayer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which no nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, In, Rh, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopädie der technischen Chemie, 4th Edition, Vol. 18, pages 431 et seq and Research Disclosure no. 17643 (Dec. 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure no. 17643 (Dec. 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfuric or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (Dec. 1978), Chapter IV.

The silver halide emulsion layers bearing the yellow couplers according to the invention contain, for example, as blue sensitizers symmetrical or asymmetrical benzimidazo-, oxa-, thia- or selenacyanines containing at least one sulfoalkyl group at the heterocyclic nitrogen and optionally other substituents at the aromatic nucleus and also apomerocyanines containing a thiocyanine group.

The following blue sensitizers BS, which may be used individually or in combination with one another, are mentioned as examples, more particularly for negative and reversal film:

BS-1:

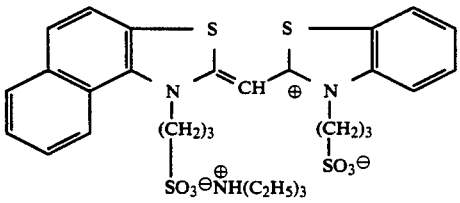

BS-2:

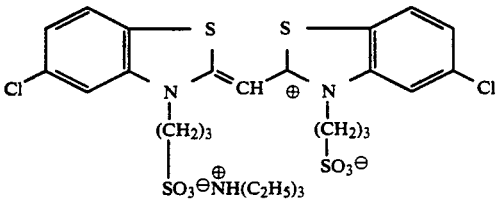

-continued

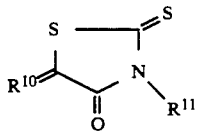

BS-3:

$R^{10}$ = 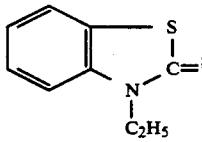 ; $R^{11}$ = $-CH_2-COOH$;

BS-4:

$R^{10}$ = 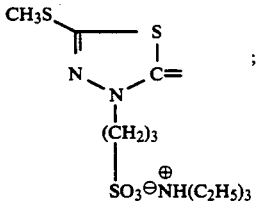 ; $R^{11}$ = $-C_2H_5$;

BS-5:

$R^{10}$ = 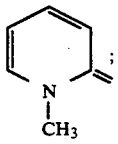 ; $R^{11}$ = $-C_2H_5$;

In the case of the yellow couplers according to the invention, there may even be no need for spectral sensitizers if the silver halide used is sufficient by virtue of its sensitivity to blue light.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type, of which the following are suitable examples:

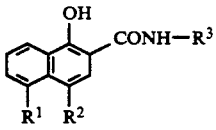

C-1: $R^1, R^2$ = H; $R^3$ = $-(CH_2)_3-O-$ 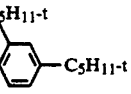

C-2: $R^1$ = $-NHCOOCH_2-CH(CH_3)_2$; $R^2$ = H; $R^3$ = $-(CH_2)_3-OC_{12}H_{25}$

C-3: $R^1$ = H; $R^2$ = $-OCH_2-CH_2-SO_2CH_3$; $R^3$ = $-C_{16}H_{33}$

C-4: $R^1$ = H; $R^2$ = $-OCH_2-CONH-(CH_2)_2-OCH_3$;

$R^3$ = $-(CH_2)_4-O-$ 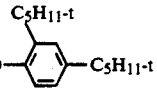

-continued

C-5: $R^1, R^2 = H; R^3 = -(CH_2)_4-O-$ 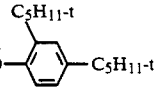 $-C_5H_{11}$-t

C-6: $R^1, R^2 = H; R^3 = -(CH_2)_4-O-$ 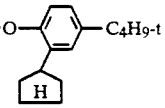 $-C_4H_9$-t

C-7: $R^1 = H; R^2 = Cl; R^3 = -C(C_2H_5)_2-C_{21}H_{43}$

C-8: $R^1 = H; R^2 = -O-CH_2-CH_2-S-CH(COOH)-C_{12}H_{25}$
$R^3$ = Cyclohexyl

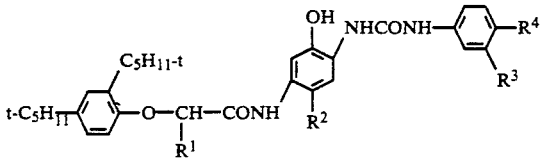

C-9: $R^1 = -C_4H_9; R^2 = H; R^3 = -CN; R^4 = Cl$

C-10: $R^1 = -C_4H_9; R^2 = H; R^3 = H; R^4 = -SO_2CHF_2$

C-11: $R^1 = -C_4H_9; R^2 =$ 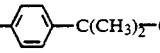 $-C(CH_3)_2-CH_2-C(CH_3)_3$;
$R^3 = H; R^4 = -CN$

C-12: $R^1 = C_2H_5; R^2, R^3 = H; R^4 = -SO_2CH_3$

C-13: $R^1 = -C_4H_9; R^2, R^3 = H; R^4 = -SO_2-C_4H_9$

C-14: $R^1 = -C_4H_9; R^2 = H; R^3 = -CN; R^4 = -CN$

C-15: $R^1 = -C_4H_9; R^2, R^3 = H; R^4 = -SO_2-CH_2-CHF_2$

C-16: $R^1 = -C_2H_5; R^2, R^3 = H; R^4 = -SO_2CH_2-CHF-C_3H_7$

C-17: $R^1 = -C_4H_9; R^2, R^3 = H; R^4 = F$

-continued

C-18: $R^1 = -C_4H_9; R^2, R^3 = H; R^4 = -SO_2CH_3$

C-19: $R^1 = -C_4H_9; R^2, R^3 = H; R^4 = -CN$

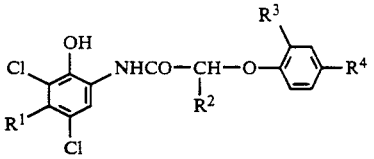

C-20: $R^1 = -CH_3; R^2 = -C_2H_5; R^3, R^4 = -C_5H_{11}$-t

C-21: $R^1 = -CH_3; R^2 = H; R^3, R^4 = -C_5H_{11}$-t

C-22: $R^1, R^2 = -C_2H_5; R^3, R^4 = -C_5H_{11}$-t

C-23: $R^1 = -C_2H_5; R^2 = -C_4H_9; R^3, R^4 = -C_5H_{11}$-t

C-24: $R^1 = -C_2H_5; R^2 = -C_4H_9; R^3, R^4 = -C_4H_9$-t

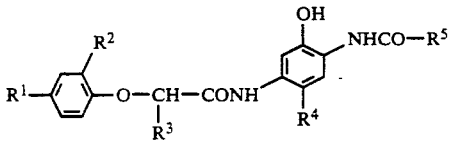

C-25: $R^1, R^2 = -C_5H_{11}$-t; $R^3 = -C_4H_9; R^4 = H; R^5 = -C_3F_7$

C-26: $R^1 = -NHSO_2-C_4H_9; R^2 = H; R^3 = -C_{12}H_{25}; R^4 = Cl;$
$R^5$ = Phenyl C-27: $R^1, R^2 = -C_5H_{11}$-t; $R^3 = -C_3H_7$-i; $R^4 = Cl;$
$R^5$ = Pentafluorphenyl C-28: $R^1 = -C_5H_{11}$-t; $R^2 = Cl; R^3 = -C_6H_{13}; R^4 = Cl;$
$R^5$ = -2-Chlorphenyl Color couplers for producing the cyan component dye image are generally couplers of the 5-pyrazolone type, the indazolone type or the pyrazoloazole type, of which the following are suitable examples:

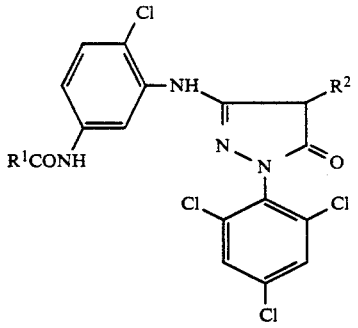

M-1: $R^1 = -O-CH(CH_3)-CH_2-O-$ 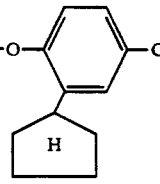 $-C_4H_9$-t; $R^2 = H$

M-2: $R^1 = -CH(C_{12}H_{25})-O-$ 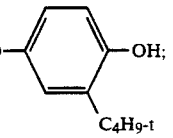 $-OH$;

-continued
$R^2 = H$
M-3: $R^1 = -C_{13}H_{27}$; $R^2 = H$
M-4: $R^1 = -OC_{16}H_{33}$; $R^2 = H$
M-5: $R^1 = -C_{13}H_{27}$;
$R^2 =$ 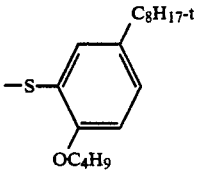
M-6: $R^1 =$ 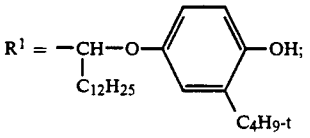
$R^2 =$ 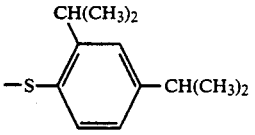
M-7: $R^1 = -C_9H_{19}$;
$R^2 =$ 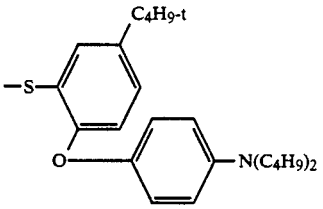
M-8: $R^1 =$ 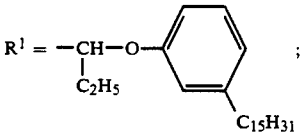 ;
$R^2 =$ 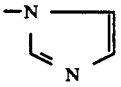
M-9: 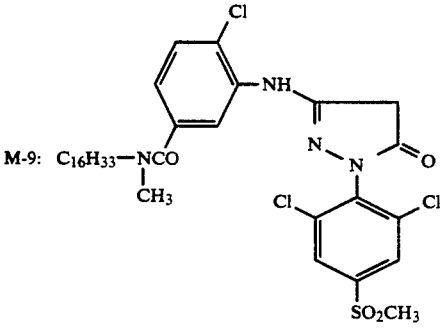

-continued
M-10: $C_8H_{17}-CH=CH-(CH_2)_8$
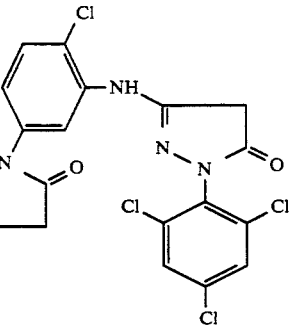
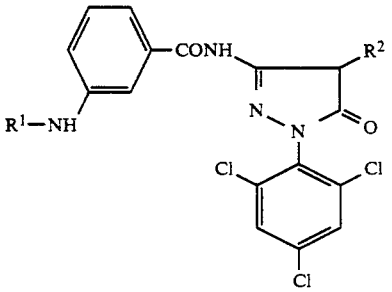
M-11: $R^1 =$ 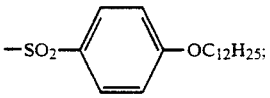
$R^2 = H$
M-12: $R^1 =$ 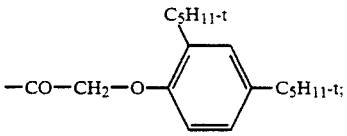
$R^2 = H$
M-13: $R^1 =$ 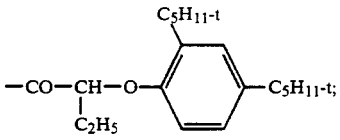
$R^2 = H$
M-14: $R^1 =$ 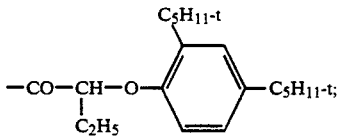
$R^2 =$ 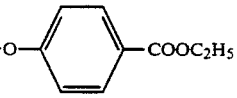

-continued
M-15: $C_{17}H_{35}CONH$
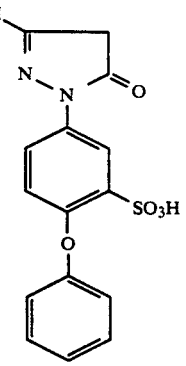
M-16:
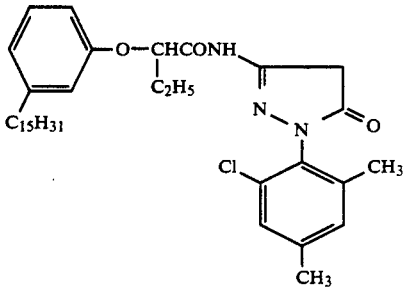
M-17: $t\text{-}C_4H_9CONH$
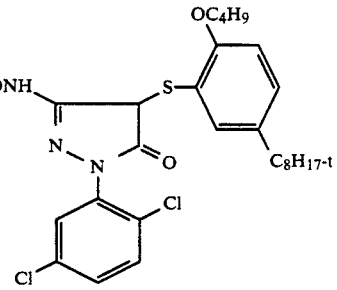
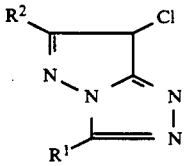
M-18: $R^1 = -(CH_2)_3-$
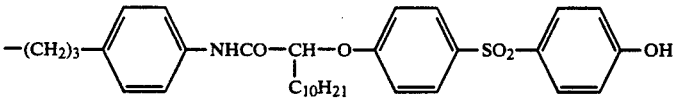
$R^2 = -CH_3$
M-19: $R^1 = -(CH_2)_3-$
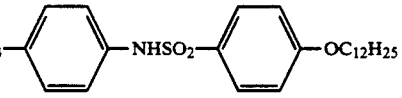
$R^2 = -CH_3$
M-20: $R^1 =$
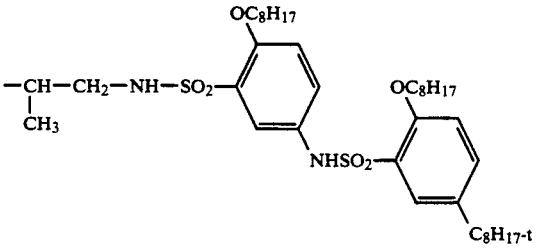

-continued $R^2 = -C_4H_9$-t

M-21: $R^1 = -(CH_2)_3-$ 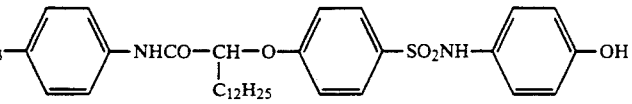

$R^2 = -CH_3$

M-22: $C_{18}H_{37}-N(CH_3)-SO_2-$ 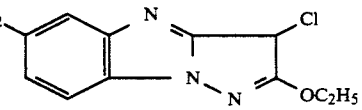

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such a these are the known DIR couplers and also DAR and FAR couplers.

Examples of white couplers are:

W-1

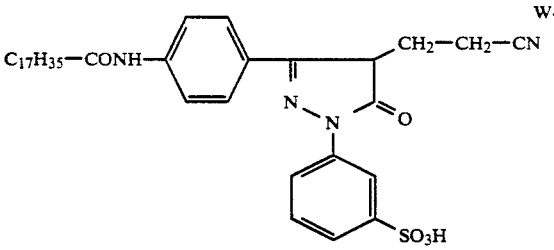

W-2

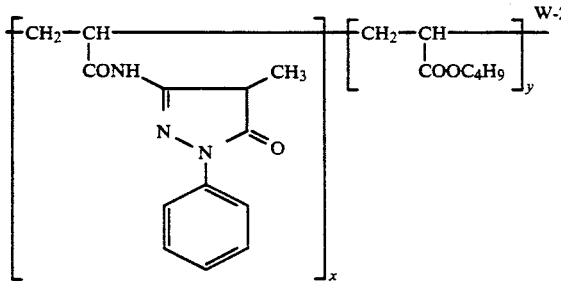

-continued

W-3

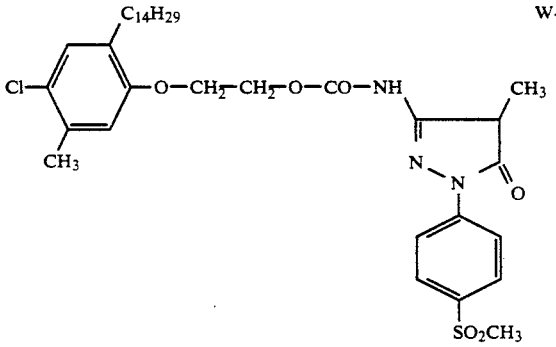

W-4

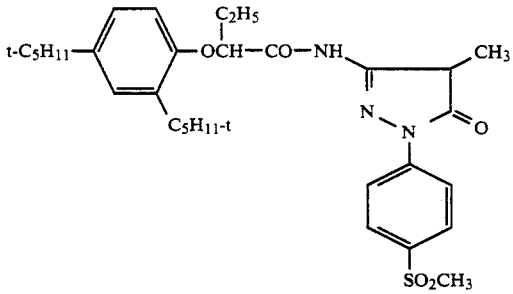

W-5

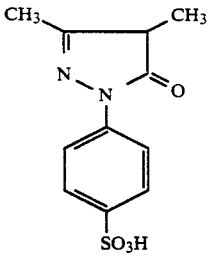

DIR couplers containing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-0 157 146 and 0 204 175, in US-A-4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-0 167 168 and 0 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-0 115 304, 0 167 173, GB-A-2,165,058, DE-A-37 00 419 and-US-A-4,707,436.

In a multilayer photographic material, the DIR couplers may be added to various layers, including for example even non-photosensitive layers or interlayers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitortrapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-0 89 834, 0 110 511, 0 118 087, 0 147 765 and in US-A-4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

The following are examples of DIR couplers:

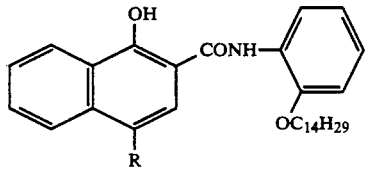

DIR-1

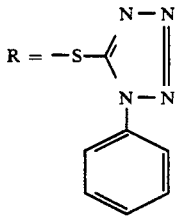

DIR-2

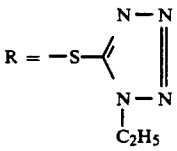

DIR-3

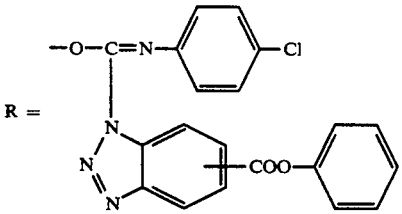

DIR-4

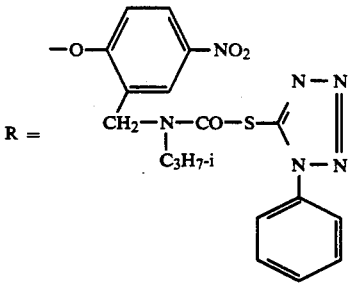

DIR-5

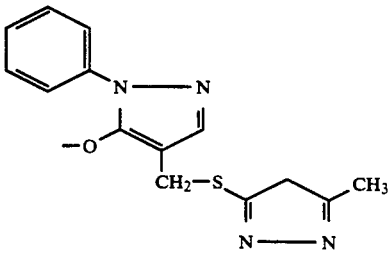

DIR-6

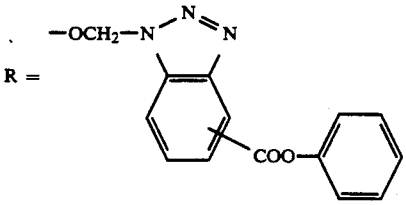

-continued
DIR-7
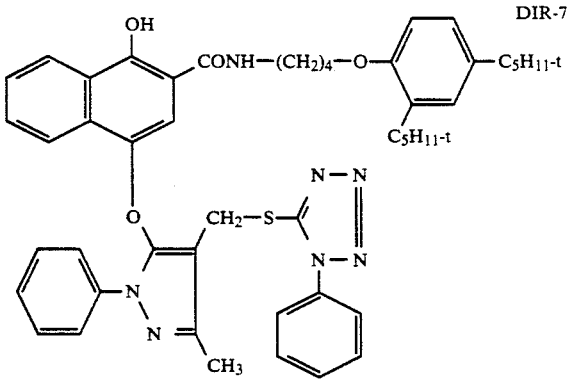
DIR-8
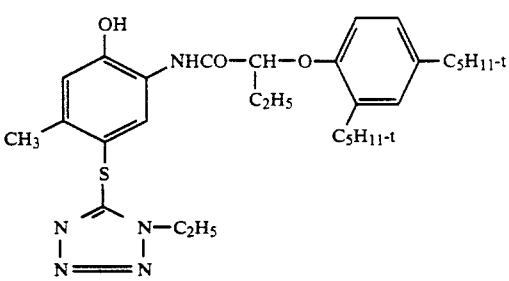
DIR-9
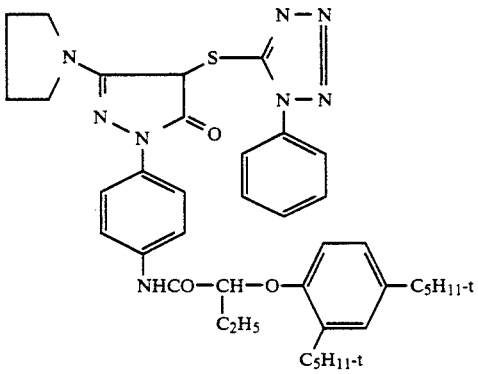
DIR-10
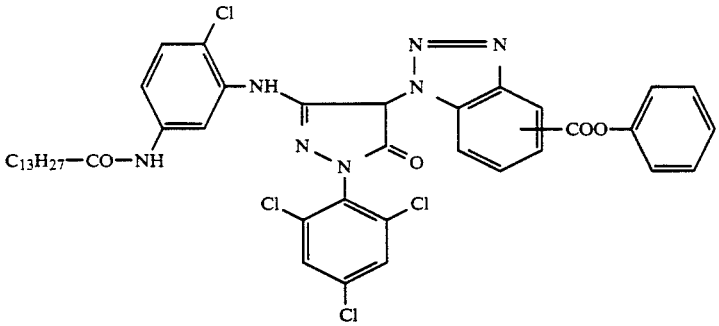
DIR-11
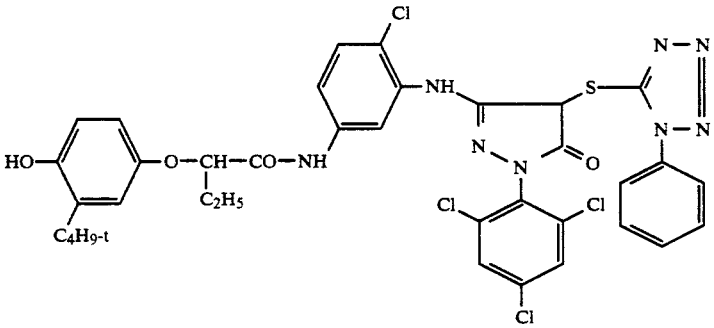

-continued
DIR-12
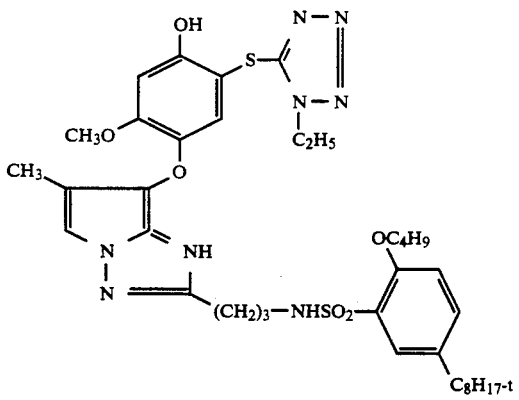
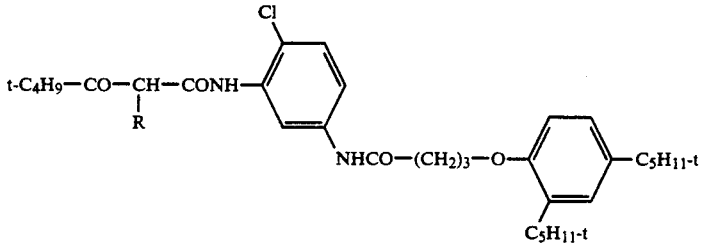
DIR-13
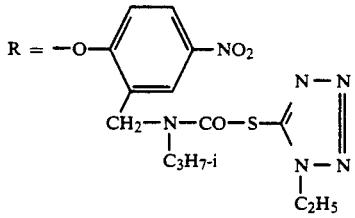
DIR-14
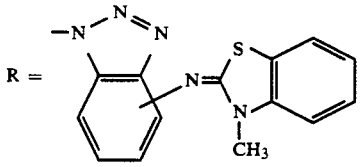
DIR-15
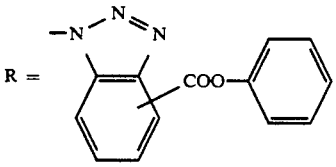
DIR-16
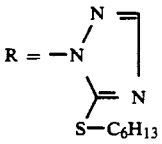
DIR-17
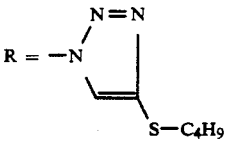
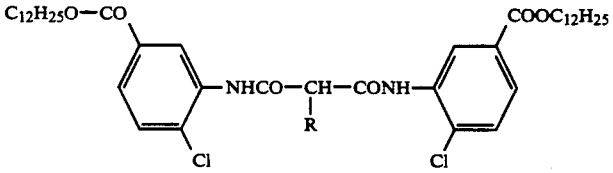
DIR-18
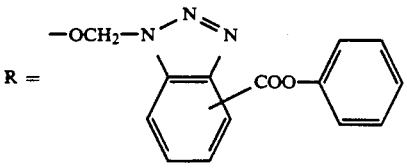
DIR-19
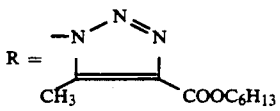

-continued

DIR-20

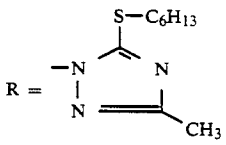

DIR-21

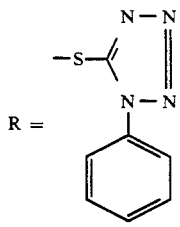

DIR-22

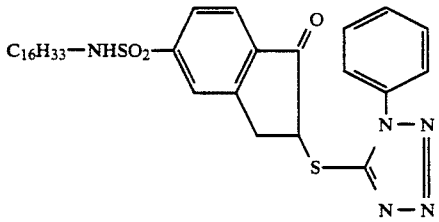

DIR-23

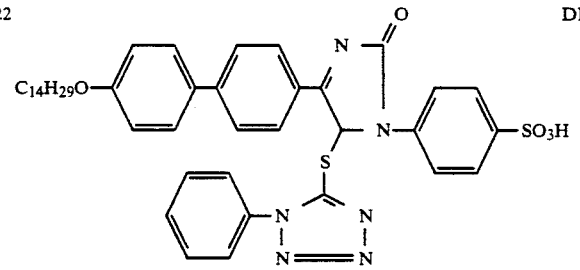

DIR-24

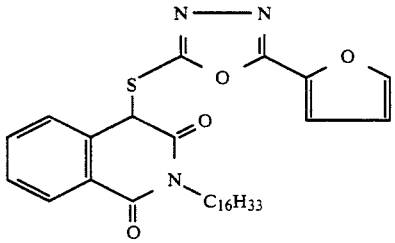

The following are examples of DAR couplers:

DAR-1

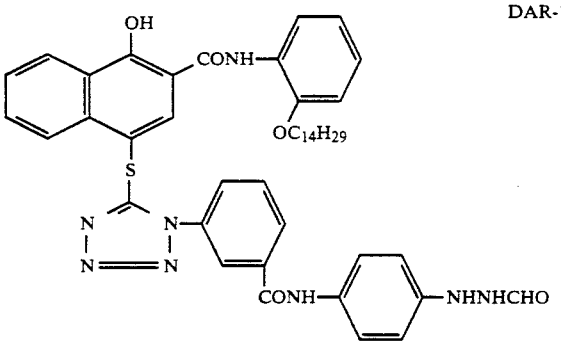

DAR-2

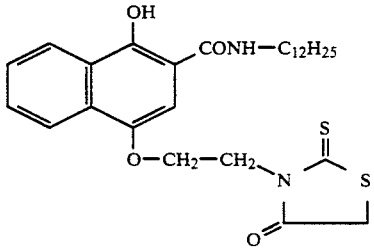

DAR-3

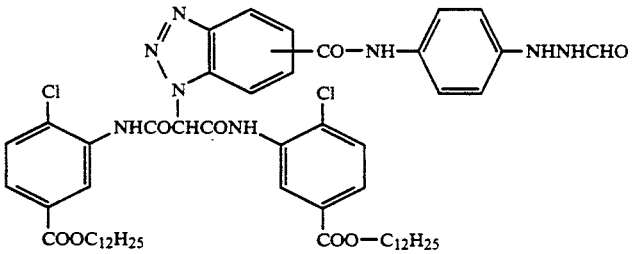

Since, in the case of activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (US-A-4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in US-A-4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, US-A-4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in US-A-2,322,027, US-A-2,801,170, US-A-2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, US-A-4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2 ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive intermediate layers generally arranged between layers of different spectral sensitivity may contain agents to prevent unwanted diffusion of developer oxidation products form one photosensitive layer into another photosensitive layer with different spectral sensitization.

Suitable agents of the type in question, which are also known as scavengers or DOP trappers, are described in Research Disclosure 17 643 (Dec. 1978), Chapter VII, 17 842 (Feb. 1979) and 18 716 (Nov. 1979), page 650 and in EP-A-0 069 070, 0 098 072, 0 124 877, 0 125 522. The following are examples of particularly suitable compounds:

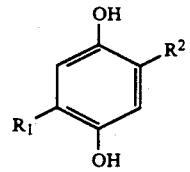

$R_1, R_2 =$ $-C_8H_{17}$-t
$-C_{12}H_{25}$-s
$-C_6H_{13}$-t
$-C(CH_3)_2-(CH_2)_3-COO-C_6H_{13}$
$-C_8H_{17}$-s
$-C_{15}H_{31}$

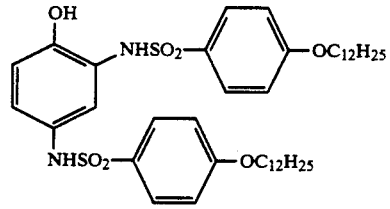

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer packet (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UVrich daylight and, on the other hand, as filter dyes to absorb the UV component of daylight on exposure and thus to improve the color reproduction of a film. Compounds of different structure are normally used for the two functions. Examples are aryl-substituted benzotriazole compounds (US-A-3,533,794), 4-thiazolidone compounds (US-A-3,314,794 and 3,352,681), benzophenone compounds (JP-A-2784/71) cinnamic acid ester compounds (US-A-3,705,805 and 3,707,375), butadiene compounds (US-A-4,045,229) or benzoxazole compounds (US-A-3,700,455).

The following are examples of particularly suitable compounds:

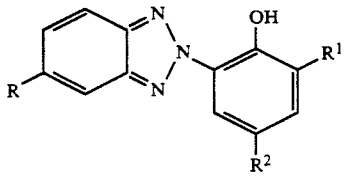

$R, R^1 = H; R^2 = -C_4H_9\text{-t}$ $R = H; R^1, R^2 = -C_4H_9\text{-t}$ $R = H; R^1, R^2 = -C_5H_{11}\text{-t}$ $R = H; R^1 = -C_4H_9\text{-s}; R^2 = -C_4H_9\text{-t}$ $R = Cl; R^1 = -C_4H_9\text{-t}; R^2 = -C_4H_9\text{-s}$ $R = Cl; R^1, R^2 = -C_4H_9\text{-t}$ $R = Cl; R^1 = -C_4H_9\text{-t}; R^2 = -CH_2-CH_2-COOC_8H_{17}$ $R = H; R = -C_{12}H_{25}\text{-i}; R^2 = -CH_3$ $R, R^1, R^2 = -C_4H_9\text{-t}$

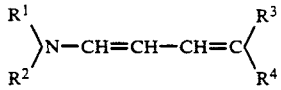

$R^1, R^2 = -C_6H_{13}\text{-n}; R^3, R^4 = -CN$ $R^1, R^2 = -C_2H_5; R^3 = -SO_2-$ 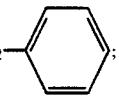 ;

$R^4 = -CO-OC_8H_{17}$ $R^1, R^2 = -C_2H_5; R^3 = -SO_2-$ 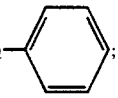 ;

$R_4 = -COO-C_{12}H_{25}$ $R^1, R^2 = -CH_2=CH-CH_2; R^3, R^4 = -CN$

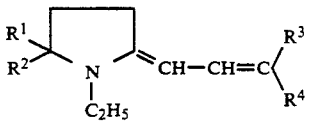

$R^1, R^2 = H; R^3 = -CN; R^4 = -CO-NHC_{12}H_{25}$

-continued $R^1, R^2 = -CH_3; R^3 = -CN; R^4 = -CO-NHC_{12}H_{25}$

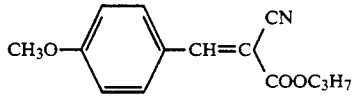

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in US-A-2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, December 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The following are examples of suitable formalin trappers:

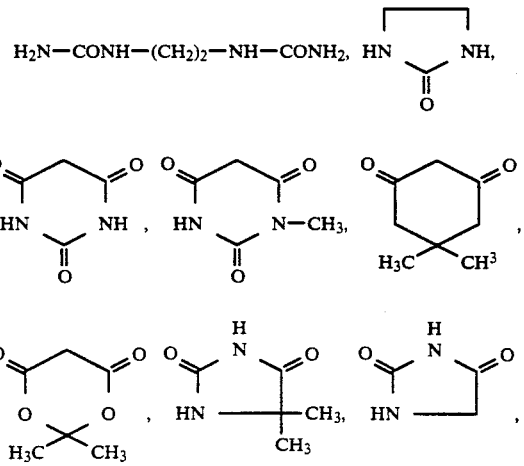

-continued

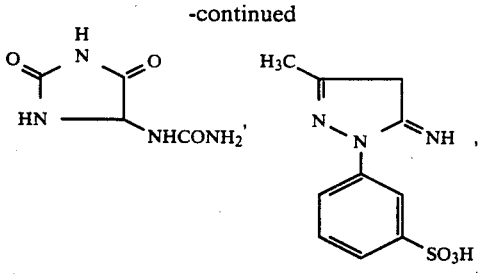

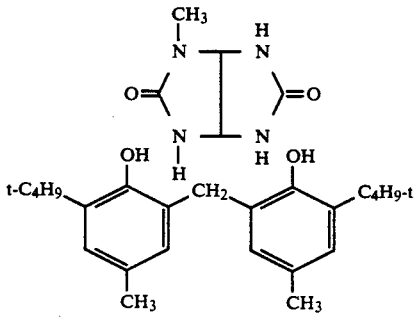

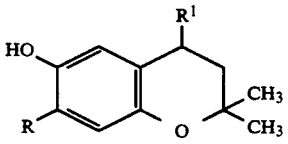

$R = -C_8H_{17}\text{-t}$; $R^1 = -CH_3$
$R = -C_8H_{17}$; $R^1 = -C_3H_7\text{-i}$

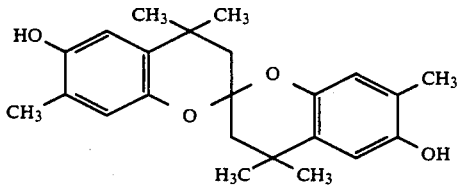

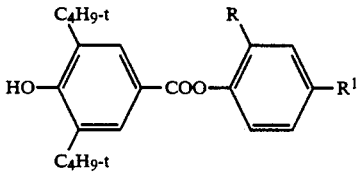

$R, R^1 = -C_4H_9\text{-t}$
$R, R^1 = -C_5H_{11}\text{-t}$

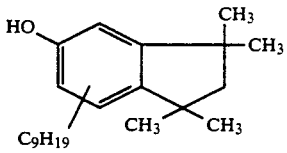

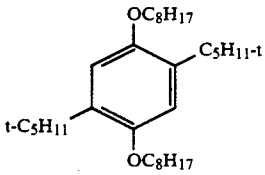

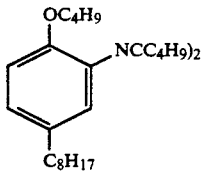

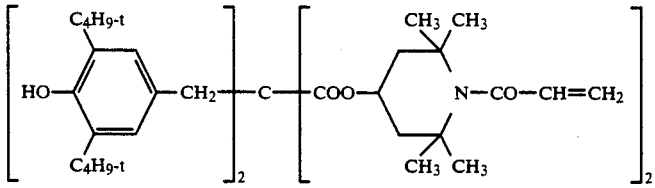

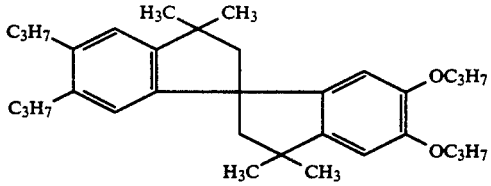

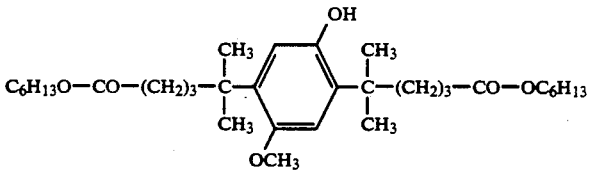

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives, containing esterified or etherified phenolic hydroxyl groups, metal complexes.

Compounds containing both a sterically hindered amine partial structure and also a sterically hindered phenol partial structure in one and the same molecule (US-A-4,268,593) are particularly effective for preventing the impairment of yellow dye images as a result of the generation of heat, moisture and light. Spiroindanes (JP-A-159 644/81) and chromanes substituted by hydroquinone diethers or monoethers (Jp-A-89 83 5/80) are particularly effective for preventing the impairment of magenta-red dye images, particularly their impairment as a result of the effect of light.

The following are examples of particularly suitable compounds:

and the compounds mentioned as DOP trappers.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (US-A-3,288,775, US-A-2,732,303, GB-A-974,723 and GB-A-1,167,207), divinylsulfone compounds acetyl-1,3-diacryloyl hexahydro-1,3,5-triazine and other compounds containing a reactive olefin bond (US-A-3,635, 718, US-A-3,232,763 and GB-A-994,869); N-hydroxymethyl phthalimide and other N-methylol compounds (US-A-2,732,316 and US-A-2,586,168); isocyanates (US-A-3,103,437); aziridine compounds (US-A-3,017,280 and US-A-2,983,611); acid derivatives (US-A-2,725,294 and US A-2,725,295); compounds of the carbodiimide type (US-A-3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (Jp-A-43353/81); N-sulfonyloximido compounds (US-A-4,111,926), dihydroquinoline compounds (US-A-4,013,468), 2-sulfonyloxy pyridinium salts (JP-A-110 762.81), formamidinium salts (EP-A-0 162 308), compounds containing two or more N-acyloximino groups (US-A-4,052,373), epoxy compounds (US-A-3,091,537), compounds of the isoxazole type (US-A-3,321,313 and US-A-543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

(a)

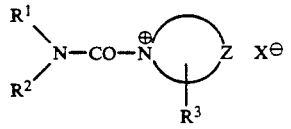

in which $R^1$ is alkyl, aryl or aralkyl, $R^2$ has the same meaning as R: or represents alkylene, arylene, aralkylene or alkaralkylene, the second bond being attached to a group corresponding to formula

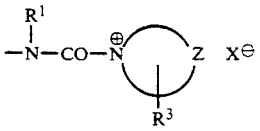

or $R^1$ and $R^2$ together represent the atoms required to complete an optionally substituted heterocyclic ring, for example a piperidine, piperazine or morpholine ring, the ring optionally being substituted, for example, by $C_{1-3}$ alkyl or halogen, $R^3$ is hydrogen, alkyl, aryl, alkoxy, $—NR^4—COR^5$, $—(CH_2)_m—NR^8R^9$, $—(CH_2)_n—CONR^{13}R^{14}$ or $$—(CH_2)_p—\underset{\underset{R^{15}}{|}}{CH}—Y—R^{16}$$

or is a bridge member or a direct bond to a polymer chain, $R^4$, $R^6$, $R^7$, $R^9$, $R^{14}$, $R^{15}$, $R^{17}$, $R^{18}$ and $R^{19}$ being hydrogen or $C_1$–$C_4$ alkyl, $R^5$ being hydrogen, $C_{1-4}$ alkyl or $NR^6R^7$, $R^8$ being $—COR^{10}$ $R^{10}$ being $NR^{11}R^{12}$, $R^{11}$ being $C_{1-4}$ alkyl or aryl, particularly phenyl, $R^{12}$ being hydrogen, $C_{1-4}$ alkyl or aryl, particularly phenyl, $R^{13}$ being hydrogen, $C_{1-4}$ alkyl or aryl, particularly phenyl, $R^{16}$ being hydrogen, $C_{1-4}$ alkyl, $COR^{18}$ or $CONHR^{19}$, m being a number of 1 to 3, n being a number of 0 to 3, p being a number of 2 to 3 and Y being O or $NR^{17}$ or $R^{13}$ and $R^{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6-membered aromatic heterocyclic ring, optionally with a fused benzene ring, and $X^{\ominus}$ is an anion which is unnecessary where an anionic group is already attached to the rest of the molecule;

(b)

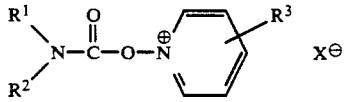

in which $R^1$, $R^2$, $R^3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-1-(N-ethyl-N-methanesulfon-amidoethyl)-3-methyl-p-phenylenediamine, 1-(N-ethyl-N-hydroxyethyl) 3-methyl-p-phenylenediamine and 1-(N-ethyl-N-methoxyethyl)-3-methyl-p-phenylenediamine. Other useful color developers are described, for example, in J. Amer. Chem. Soc. 73 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. Development is followed by a diffuse second exposure and then by development with a color developer, bleaching and fixing.

EXAMPLE 7.3 g of yellow coupler Y-2 according to the invention were dissolved in 15 ml ethyl acetate, 5 ml dibutyl phthalate and 5 ml of a 10% aqueous solution of the sodium salt of a $C_{12}$ alkyl naphthyl sulfonic acid and the resulting solution is emulsified at 60 C in 150 ml 7.5% aqueous gelatine solution. 126 ml of a silver bromide chloride emulsion (90 mol-% AgBr) with a silver content corresponding to 6.8 g $AgNO_3$ were added to the final emulsate. This casting solution was cast onto a polyethylene-coated paper at 40° C. to give an $AgNO_3$ coating of 1.5 g/m$^2$.

The samples were exposed behind a grey step wedge, developed int eh following color developer once with and once without benzyl alcohol and subsequently bleached/ fixed, rinsed and dried.

| | |
|---|---|
| Color developer | |
| (Benzyl alcohol | 15 ml) |
| Potassium carbonate | 30 g |
| Potassium bromide | 0.5 g |
| Hydroxylamine sulfate | 2 g |
| Sodium sulfite | 2 g |
| Diethylene triamine | 1 g |
| N-Ethyl-N-β-methanesulfonamido-ethyl-3-methyl-4-aminoaniline sulfate | 4.5 g |
| Make up with water to | 1 l |
| Bleaching/fixing bath | |
| Ammonium thiosulfate (70%) | 150 ml |
| Sodium sulfate | 5 g |
| Na[Fe (EDTA)] | 40 g |
| EDTA | 4 g |
| Make up with water to | 1 l |

| Color development process | Temp. (°C.) | Time |
|---|---|---|
| 1. Colour development | 33 | 3 mins. 30 s |
| 2. Bleaching/fixing | 33 | 1 mins. 30 s |
| 3. Washing with water | 26 | 2 mins. |
| 4. Drying | | |

the processed samples showed the sensitometric differences in regard to sensitivity listed in the following Table, E1-E2 being the difference in the sensitivities obtained with (E1) and without (E2) benzyl alcohol and D1 and D2 being the maximum color densities obtained with (D1) and without (D2) benzyl alcohol.

TABLE

| Coupler | E1-E2 | D1 | D2 | D2/D1 |
|---|---|---|---|---|
| | −0.2 | 2.6 | 2.6 | 1.0 |

The Example shows that the yellow couplers according to the invention give extremely constant color densities and, in addition, substantially constant sensitivity whether or not benzyl alcohol is present in the color developer.

We claim:

1. A color photographic recording material containing at least one photosensitive silver halide emulsion layer and, associated therewith, a non-diffusing α-acylacetanilide yellow coupler of which the anilide group is substituted by a substituent containing an N-acylsulfamoyl group, characterized in that the yellow coupler corresponds to the following formula

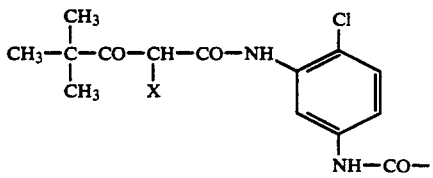

-continued

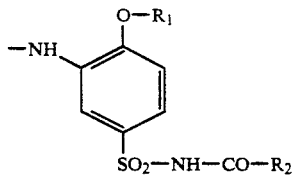

in which

X is a group releasable during the color coupling reaction;

$R_1$ is alkyl;

$R_2$ is alkyl.

2. A recording material as claimed in claim 1, characterized in that R represents alkyl containing at least 8 C atoms.

3. A recording material as claimed in claim 2, characterized in that $R_2$ represents alkyl containing at least 1 to 4 C atoms.

4. A recording material as claimed in claim 1, characterized in that $R_2$ represents aralkyl.

* * * * *